US011739627B2

(12) United States Patent
Chen et al.

(10) Patent No.: US 11,739,627 B2
(45) Date of Patent: Aug. 29, 2023

(54) ERROR-SPACE FEEDBACK CONTROLLER FOR DRILL BIT STEERING

(71) Applicant: Halliburton Energy Services, Inc., Houston, TX (US)

(72) Inventors: Yuanyan Chen, Houston, TX (US); Robert P. Darbe, Houston, TX (US); Nazli Demirer, Tomball, TX (US); Khunsa Hisham, Houston, TX (US); Shahin Tasoujian, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/546,906

(22) Filed: Dec. 9, 2021

(65) Prior Publication Data

US 2023/0184081 A1 Jun. 15, 2023

(51) Int. Cl.
*E21B 44/02* (2006.01)
*E21B 7/04* (2006.01)

(52) U.S. Cl.
CPC ..... *E21B 44/02* (2013.01); *E21B 7/04* (2013.01); *E21B 2200/20* (2020.05)

(58) Field of Classification Search
CPC ..... E21B 44/02; E21B 44/005; E21B 44/00; E21B 2200/20; E21B 33/00; E21B 7/04
See application file for complete search history.

(56) References Cited

U.S. PATENT DOCUMENTS 5,819,202 A 10/1998 Sato et al.
10,662,753 B2 5/2020 Dykstra et al.
10,746,009 B2 8/2020 Hoehn et al.
10,876,389 B2 12/2020 Dykstra et al.
2012/0217067 A1* 8/2012 Mebane, III ..... E21B 44/02 175/57
2015/0330209 A1 11/2015 Panchal et al.
2017/0335670 A1* 11/2017 Dykstra ..... E21B 44/00
2019/0317516 A1 10/2019 Zhu et al.
2020/0072034 A1 3/2020 Zalluhoglu et al.
2020/0095860 A1* 3/2020 Zalluhoglu ..... E21B 47/022
(Continued)

FOREIGN PATENT DOCUMENTS

WO 2015-041630 3/2015

OTHER PUBLICATIONS

Van De Wouw, N., N. A. H. Kremers, and E. Detournay. "Output-feedback inclination control of directional drilling systems." IFAC-PapersOnLine 48.6 (2015): 260-265.
(Continued)

*Primary Examiner* — Kristyn A Hall
(74) *Attorney, Agent, or Firm* — Benjamin Ford; C. Tumey Law Group PLLC

(57) ABSTRACT

A variety of methods, systems, and apparatus are disclosed, including, in one embodiment a method of steering a drilling bit including: determining at least one control command to a drilling system, wherein the control command includes a combination of one or more nominal control commands output from a feedforward controller and one or more control command error values output from a feedback controller operating in an error space; and directing the drill bit of the drilling system in the wellbore based on at least the control command to extend the wellbore towards a planned depth-based wellbore trajectory.

20 Claims, 6 Drawing Sheets

(56) References Cited

U.S. PATENT DOCUMENTS

| | | | |
|---|---|---|---|
| 2021/0071477 | A1 | 3/2021 | Zhao et al. |
| 2021/0103843 | A1 | 4/2021 | Keller et al. |

OTHER PUBLICATIONS

Klančar, Gregor, and Igor Škrjanc. "Tracking-error model-based predictive control for mobile robots in real time." Robotics and autonomous systems 55.6 (2007): 460-469.

Demirer, Nazli, et al. "Autonomous directional drilling with rotary steerable systems" 2019 American Control Conference (ACC). IEEE, 2019.

Mickle, Michael C., Rui Huang, and J. Jim Zhu. "Unstable, nonminimum phase, nonlinear tracking by trajectory linearization control." Proceedings of the 2004 IEEE International Conference on Control Applications, 2004.. vol. 1. IEEE, 2004.

Kayacan, Erkan, Herman Ramon, and Wouter Saeys "Robust trajectory tracking error model-based predictive control for unmanned ground vehicles." IEEE/ASME Transactions on Mechatronics 21.2 (2015): 806-814.

International Search Report and Written Opinion for Application No. PCT/US2021/064718, dated Aug. 30, 2022.

* cited by examiner

ERROR-SPACE FEEDBACK CONTROLLER FOR DRILL BIT STEERING

BACKGROUND

The oil and gas industry may use wellbores as fluid conduits to access subterranean deposits of various fluids and minerals, which may include hydrocarbons. There may be a direct correlation between the productivity of a wellbore and the interfacial surface area through which the wellbore intersects a target subterranean formation. For this reason, it may be economically desirable to increase the length of a drilled section within a target subterranean formation by means of extending a horizontal, slant-hole, or deviated wellbore through the target subterranean formation. Additionally, horizontal, slant-hole, and deviated drilling techniques may be utilized in operational contexts where the surface location is laterally offset from the target subterranean formation such that the target subterranean formation may not be accessible by vertical drilling alone.

It may be important to pre-plan and adhere to a preferred planned wellbore trajectory in order to maximize the extended length of the wellbore through the target subterranean formation. The drilling model may be formulated as three different subsystems including the bit/rock interface law, kinematic relationships between bit penetration and the geometry of the wellbore, and a Bottom Hole Assembly ("BHA") model which may relate wellbore geometry with the force acting on the BHA.

The ability to build curvature in a horizontal, slant-hole, or deviated well may be referred to as the "build rate," of the well. Developing a particular "build rate," may be directly correlated to maintaining a certain "dogleg severity," ("DLS") which may be a measure of the change of direction in a wellbore over a length of the wellbore as the well is being drilled. In a non-limiting example, the planned depth-based well trajectory may include a table of parameters that vary sequentially to build the curvature of the well in relation to the total vertical depth of the drilled wellbore. Previous technologies may have required experienced technical personnel to acquire, monitor, and assess data in order to modify the drilling process to successfully extend the wellbore through the subterranean formations according to the planned depth-based well trajectory.

Technological advances in computerized and autonomous systems may be applied to current operations in order to both enhance the decision-making process for experienced technical personnel as well as potentially automate portions of the drilling process. One method which may be utilized to integrate automation into the drilling process includes the implementation of feedback loops. Feedback loops may require iterative computations over a large search space, so while they may be technically accurate, they may also be computationally intensive or even computationally prohibitive. As such, the computational time and capacity required to determine a path forward at each survey point exclusively by means of feedback loops may be prohibitive to their adoption in real-time operations. A method that incorporates the accuracy of feedback loops while reducing the computational requirements for solution convergence may be desirable.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
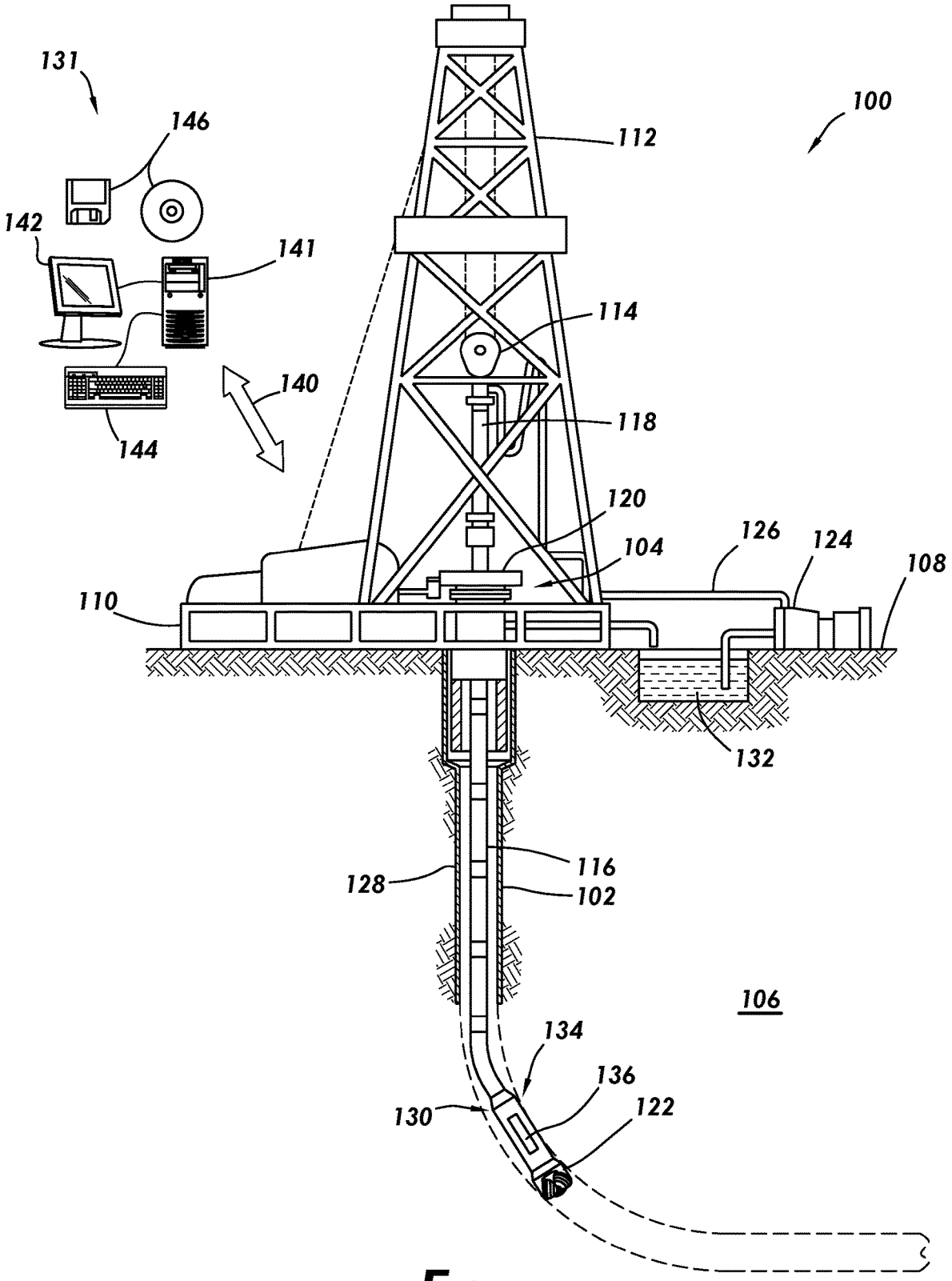
FIG. 1 illustrates an example of a drilling system and operation.

Disclosed herein are methods and systems for drilling a wellbore and, more particular, disclosed herein are methods and systems for directing a bottomhole assembly of a drilling system.

This disclosure details methods and systems to identify operational set points to drill a wellbore according to a planned depth-based well trajectory. In some embodiments, the wellbore may have a non-vertical profile, such as direction, deviated, or slant-hole profile. In a non-limiting example, the planned depth-based well trajectory may include a table of parameters that vary sequentially to build the curvature of a well in relation to the total vertical depth of the wellbore. These parameters may include metrics such as attitude (inclination and azimuth), dog-leg severity ("DLS"), weight-on-bit ("WOB"), rate of penetration ("ROP"), wellbore coordinates, and other directional drilling parameters. To achieve these objectives, operational set points may be provided to the directional drilling equipment in order to steer a drill bit along the correct depth-based trajectory. These operational set points may be referred to as "control commands," or "input commands." Non-limiting examples of control commands for drilling operations may include parameters such as tool face ("TF") and duty cycle.

Closed-loop control systems, which may include feedback controllers, may be able to determine accurate control commands to achieve a target objective. Non-limiting examples of these objectives may include controlling the position of a drilled wellbore, or maintaining a specific wellbore attitude, which may be based on the inclination and azimuth of the wellbore. Feedback controllers may react to changes in the system and control commands, as well as reacting to irregular system responses or other system disturbances. Due to the iterative nature of a closed-loop control system, determining control commands using feedback controllers may be computationally intensive. This may be particularly true in situations where the physical properties of a system, which may be referred to as a "plant model," display non-linear behavior.

With respect to drilling a non-vertical wellbore, it may be beneficial to have a methodology to accurately determine the control commands required to achieve a planned depth-based well trajectory in a manner that minimizes computational intensity. A reduction in the computational requirement may be achieved by using an open-loop controller, such as a feedforward controller, to identify nominal inputs. Incorporating these nominal inputs with a feedback controller may reduce the error-space in which the control commands may be iteratively identified. The feedback controller may determine the control commands by either minimizing or maximizing a cost function. Furthermore, utilizing the nominal inputs from the feedforward controller with the feedback controller may result in an accurate solution with lower computational requirements than a controller structure which solely relies on feedback. The resulting solution may provide control commands to enable a drilling system to accurately drill to one or more targets along a predefined depth-based trajectory.

FIG. 1 illustrates an example of drilling system 100. As illustrated, wellbore 102 may extend from a wellhead 104 into a subterranean formation 106 from a surface 108. Generally, wellbore 102 may include horizontal, vertical, slanted, curved, and other types of wellbore geometries and orientations. Wellbore 102 may be cased or uncased. In examples, wellbore 102 may include a metallic member. By way of example, the metallic member may be a casing, liner, tubing, or other elongated steel tubular disposed in wellbore 102.

As illustrated, wellbore 102 may extend in a generally vertical manner through portions of subterranean formation 106, however wellbore 102 may also extend at an angle through subterranean formation 106 to construct a horizontal, deviated, or slant-hole wellbore. It should further be noted that while FIG. 1 generally depicts land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. Drill string 116 may include, but is not limited to, drill pipe and coiled tubing, as generally known to those skilled in the art. A kelly 118 may support drill string 116 as it may be lowered through a rotary table 120. A drill bit 122 may be attached to the distal end of drill string 116 and may be driven either by a downhole motor, rotary steerable system ("RSS"), and/or via rotation of drill string 116 from surface 108. Without limitation, drill bit 122 may include, roller cone bits, PDC bits, natural diamond bits, any hole openers, reamers, coring bits, and the like. As drill bit 122 rotates, it may create and extend wellbore 102 that penetrates various subterranean formations 106. A pump 124 may circulate drilling fluid through a feed pipe 126 through kelly 118, downhole through interior of drill string 116, through orifices in drill bit 122, back to surface 108 via annulus 128 surrounding drill string 116, and into a retention pit 132.

With continued reference to FIG. 1, drill string 116 may begin at wellhead 104 and may traverse wellbore 102. Drill bit 122 may be attached to a distal end of drill string 116 and may be driven, for example, either by a downhole motor and/or via rotation of drill string 116 from surface 108. Drill bit 122 may be a part of bottom hole assembly 130 at the distal end of drill string 116. BHA 130 may further include tools for directional drilling applications. As will be appreciated by those of ordinary skill in the art, BHA 130 may include a measurement-while drilling (MWD) and/or logging-while drilling (LWD) system, magnetometers, accelerometers, agitators, bent subs, orienting subs, mud motors, RSS, jars, vibration reduction tools, roller reamers, pad pushers, non-magnetic drilling collars, push-the-bit systems, point-the-bit systems, and other directional drilling tools. The aforementioned directional drilling tools may operate by commands determined and relayed by technical staff or they may operate fully autonomously. The directional drilling tools may also operate in a hybrid manner where autonomous calculations are reviewed and confirmed by technical staff prior to executing additional components of the operation.

BHA 130 may include any number of sensors 136, tools, transmitters, and/or receivers to perform downhole measurement operations. For example, as illustrated in FIG. 1, BHA 130 may include a measurement assembly 134. It should be noted that measurement assembly 134 may make up at least a part of BHA 130. Without limitation, any number of different measurement assemblies, communication assemblies, battery assemblies, computational assemblies, and/or the like may form BHA 130 with measurement assembly 134. Additionally, measurement assembly 134 may form BHA 130 itself. In examples, measurement assembly 134 may include at least one sensor 136, which may be disposed at the surface of measurement assembly 134. It should be noted that while FIG. 1 illustrates a single sensor 136, there may be any number of sensors 136 disposed on or within measurement assembly 134. Further, it should be noted that there may be any number of sensors 136 disposed along BHA 130 (e.g., on drill bit 122) at any degree from each other. Any suitable sensors may be used for the sensors. Non-limiting examples of the sensor 136 include any instrument operable to measure, estimate, or infer the true vertical depth of the drill bit 122 (or another component of the BHA 130), the position of the drill bit 122, the azimuth of the drill bit 122, the inclination of the drill bit 120, the tortuosity of the trajectory of a recently-formed section of the wellbore 102, the threshold smoothness of the trajectory of the well bore 102, the rate of change in a curvature of the trajectory of the well bore 102, as well as other measurements of the drill bit 120 (such as, but not limited to, the weight on bit, torque on bit, rotations per minute, and acceleration), another component deployed proximate the sensor 136, or the recently-formed section of the wellbore 102. In some embodiments, the sensor 136 is also operable to determine one or more properties of fluids flowing past the sensor 136, an area of the wellbore 102 proximate to the sensor 136, and an area of the surrounding formation 112 proximate the sensor 136. Examples of such properties include, but are not limited to, material properties, temperature, pressure, salinity, pH, viscosity, vibration, noise level, as well as other measurable properties of the fluids, the wellbore 102 and the surrounding formation 112. In some embodiments, the sensor 136 may include one or more of an accelerometer, gyroscope, magnetometer, acoustic sensor (sometimes referred to as sonic), neutron sensor, gamma ray sensor, photoelectric sensor, nuclear magnetic resonance imaging sensor, tools to measure weight on bit, tools that measure torque on bit, tools that measure the bending moment, electromagnetic tools, or any combination thereof.

Without limitation, BHA 130 may be connected to and/or controlled by information handling system 131, which may be disposed on surface 108. Without limitation, information handling system 131 may be disposed down hole in BHA 130. Processing of information recorded may occur down hole and/or on surface 108. Processing occurring downhole may be transmitted to surface 108 to be recorded, observed, and/or further analyzed. Additionally, information recorded on information handling system 131 that may be disposed down hole may be stored until BHA 130 may be brought to surface 108. In examples, information handling system 131 may communicate with BHA 130 through a communication line (not illustrated) disposed in (or on) drill string 116. In examples, wireless communication may be used to transmit information back and forth between information handling system 131 and BHA 130. Information handling system 131 may transmit information to BHA 130 and may receive as well as process information recorded by BHA 130. In examples, a downhole information handling system (not illustrated) may include, without limitation, a microprocessor or other suitable circuitry, for estimating, receiving, and processing signals from BHA 130. Downhole information handling system (not illustrated) may further include additional components, such as memory, input/output devices, interfaces, and the like. In examples, while not illustrated, BHA 130 may include one or more additional components, such as analog-to-digital converter, filter, and amplifier, among others, that may be used to process the measurements of BHA 130 before they may be transmitted to surface 108. Alternatively, raw measurements from BHA 130 may be transmitted to surface 108.

Any suitable technique may be used for transmitting signals from BHA 130 to surface 108, including, but not limited to, wired pipe telemetry, mud-pulse telemetry, acoustic telemetry, and electromagnetic telemetry. While not illustrated, BHA 130 may include a telemetry subassembly that may transmit telemetry data to surface 108. At surface 108, pressure sensors (not shown) may convert the pressure signal into electrical signals for a digitizer (not illustrated). The digitizer may supply a digital form of the telemetry signals to information handling system 131 via a communication link 140, which may be a wired or wireless link. The telemetry data may be analyzed and processed by information handling system 131.

As illustrated, communication link 140 (which may be wired or wireless, for example) may be provided that may transmit data from BHA 130 to an information handling system 131 at surface 108. Information handling system 131 may include a personal computer 141, an output device 142 (e.g., video display), input device 144 (e.g., keyboard, mouse, etc.) and/or non-transitory computer-readable media 146 (e.g., optical disks, magnetic disks) that can store code representative of the methods described herein. In addition to, or in place of processing at surface 108, processing may occur downhole. As discussed below, methods may be utilized by information handling system 131 to accurately steer drill bit 122 and BHA 130 of drilling system 100 in order to minimize unplanned deviations from the planned depth-based well trajectory.

Information handling system 131 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 131 may be a personal computer, a network storage device, or any other suitable device and may vary in size, shape, performance, functionality, and price. Information handling system 131 may include random access memory (RAM), one or more processing resources such as a central processing unit 134 (CPU) or hardware or software control logic, ROM, and/or other types of nonvolatile memory. Additional components of the information handling system 131 may include non-transitory computer-readable media 146, output devices 142, and one or more network ports for communication with external devices as well as an input device 144 (e.g., keyboard, mouse, etc.). Information handling system 131 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 2:
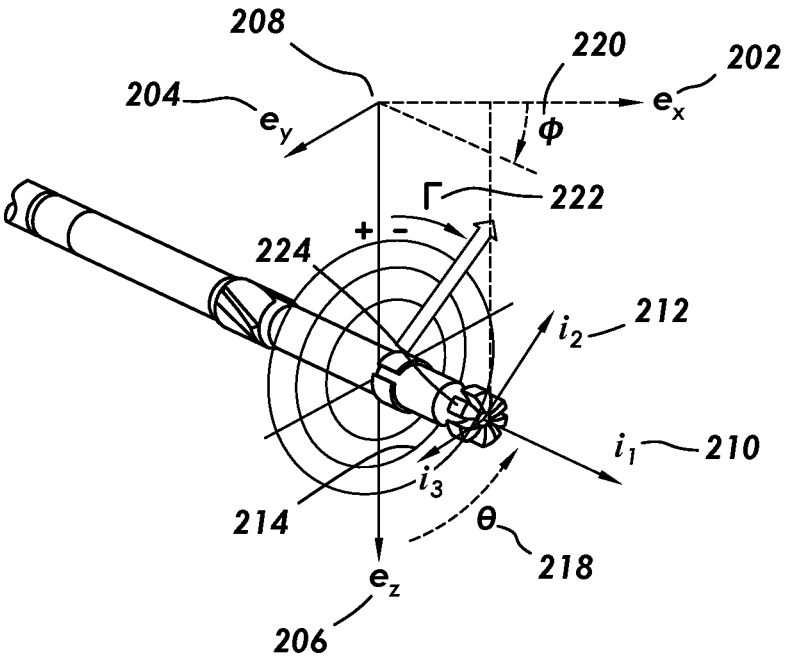
FIG. 2 illustrates 3-D coordinate systems for a drilling system.

FIG. 2 illustrates an example of a 3-dimentional directional drilling model for drilling. With the model, the attitude of the drilling tool 224 (e.g., BHA 130 or drill bit 122 on FIG. 1) may be uniquely determined within Cartesian coordinate system 208 with reference to local coordinate system ($i_1$, $i_2$, $i_3$). Cartesian coordinate system 208 may include an x axis 202, a y axis 204, and a z axis 206 where z axis 206 is oriented parallel to the direction of gravity. Local coordinate system ($i_1$, $i_2$, $i_3$) may be attached to datum point on a drilling tool 224 (shown on FIG. 2 as a bit) where axis $i_1$ 210 runs parallel to the axis of bit 224 and axis $i_2$ 212 is aligned in the same vertical plane as axis $i_1$ 210. As the wellbore is extended through the subterranean formation, the attitude of the drilling tool 224 may include one or more inclinations 218 and azimuths 220. As depicted, inclination 218 may be determined as the angle between axis $i_1$ 210 and z axis 206 while azimuth 220 may be determined between x axis 202 and the projection of axis $i_1$ 210 onto the horizontal plane created by x axis 202 and y axis 204. The aforementioned attitudes and orientations may be referred to as "states" and may describe the geometry of the wellbore as it is extended into the subterranean formation as well as defining the location and orientation of the drilling tool 224.

Figure 3:
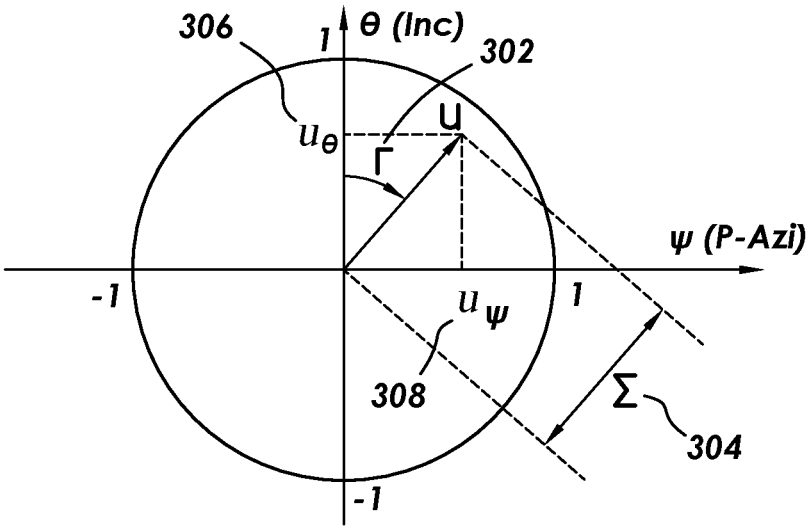
FIG. 3 illustrates a graphical depiction of tool face and steering ratio.

Steering commands, which may include tool face ("TF") and steering ratio, may allow for a wellbore to be drilled according to a planned depth-based wellbore trajectory. TF may be the direction in which a drill bit (e.g., drill bit 122 on FIG. 1) is pointed and subsequently steered and may further be measured in degrees ranging from 0 to 360. Steering ratio may be the scaled magnitude of the steering force applied in the direction of the TF where a value of 1 represents utilizing the maximum curvature-generating ability of the drilling tool. FIG. 3 illustrates both the TF 302 and the steering ratio 304 within the plane created from inclination and a local parameter which may be referred to as the pseudo-azimuth. Pseudo-azimuth may be used to relate the instantaneous wellbore evolution in local coordinate system ($i_1$, $i_2$, $i_3$) to the azimuth defined in Cartesian coordinate system 208. FIG. 3 further illustrates that it may be possible to develop a relationship which converts Steering ratio 304 and TF 302 into inputs on the plane of inclination and pseudo-azimuth.

Referring again to FIG. 1, due to the layout and spacing of BHA 130 and drill bit 122, the actual orientation of drill bit 122 may not be known. Although sensors 136 may be placed closer to drill bit 122, the most reliable wellbore orientation information may be obtained from stationary survey measurements originating from sensors 136 on BHA 130. There may be multiple feet of drilled wellbore 102 extending in the axial direction between BHA 130 and drill bit 122 which are not captured by the stationary measurements until BHA 130 has progressed through the full length of the newly drilled portion of wellbore 102. It may be possible to estimate the drilled wellbore trajectory and drill bit 122 location ahead of BHA 130 to create a projection of drill bit 122 location. This may be referred to as the "bit projection," and may be determined or estimated from a wellbore propagation model. Additional physical and operational variables may create inherent errors and uncertainties in the drilling operation such that without proper monitoring and control the extension of the wellbore may deviate from the desired planned depth-based well trajectory. In non-limiting examples, such variables may include the mechanical properties of the subterranean formation 106, geological heterogeneities, formation dip angles, geological folding and faulting, drill bit type, bit hydraulics, improper hole cleaning, mud motor properties, drill string design and characteristics, and human error.

Figure 4:
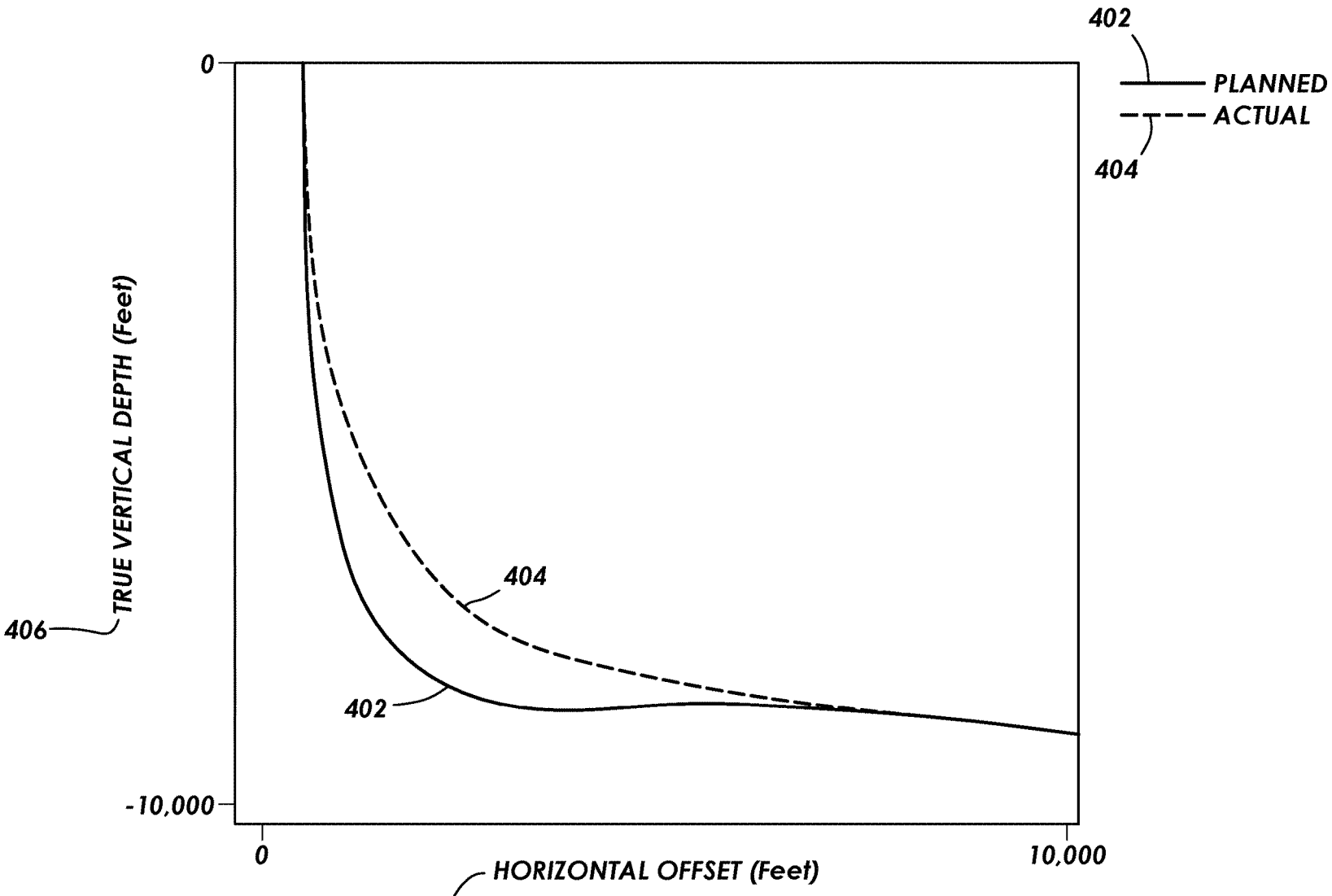
FIG. 4 illustrates a planned depth-based well trajectory and an actual wellbore trajectory.

FIG. 4 illustrates an example departure between the profiles of the planned depth-based well trajectory 402 and the actual drilled wellbore trajectory 404. The y-axis 406 of the plot, labelled True Vertical Depth ("TVD"), has a maximum value of zero which may be thought of as the surface of the earth (e.g., surface 108 on FIG. 1) or the surface of the ocean floor. The x-axis 408 of the plot is labelled Horizontal Offset, where increasing footage values from left to right represent an extension of the wellbore in a horizontal direction. The example illustrated in FIG. 4 depicts a single comparison of a planned depth-based well trajectory 402, and an actual drilled well trajectory 404. Even with a similar subterranean environment, many other trajectories and wellbore configurations are possible assuming different control commands and operational parameters are used. When redirecting a wellbore from a vertical to a horizontal orientation, which may be referred to as "building the curve," the operational objective may be to steer the wellbore such that it tracks accurately with the reference well plan to minimize tortuosity. Once the wellbore is oriented to extend in the horizontal direction, the operational objective may be directed to geo-steering the well where it may be desirable to achieve and/or maintain a reference inclination and azimuth.

Regardless of the operational objective, it may be important to measure and assess the attitude and coordinates of the BHA from the sensors (e.g., sensors 136 on BHA 130 shown on FIG. 1), identify whether the operational objective is being achieved, and determine the next set of control commands required to steer the bit to the intended target. These functions may be performed in real-time where real-time may be construed as monitoring, gathering, and/or assessing data contemporaneously with the execution of an operation. Real-time operations may further include modifying the initial design or execution of the planned operation in order to achieve a specific planned depth-based well trajectory. In some examples, a feedback controller, such as a model predictive control ("MPC") formulation may be used in real-time to minimize a cost function along an MPC horizon. In other examples, the feedback controller may seek to maximize the cost function along the MPC horizon during real-time operations. Model Predictive Control may utilize a model of the plant to predict the future evolution of the system. A performance index may be optimized under the operating constraints of the system based on each prediction. This may allow a sequence of future control commands (or steering commands) to best follow a given planned depth-based well trajectory where the optimization may be solved over a shift prediction horizon. As previously mentioned, solving a trajectory tracking problem using a feedback model to minimize or maximize a cost function to identify control commands may require significant computational infrastructure without a methodology to reduce the computational requirements.

Figure 5:
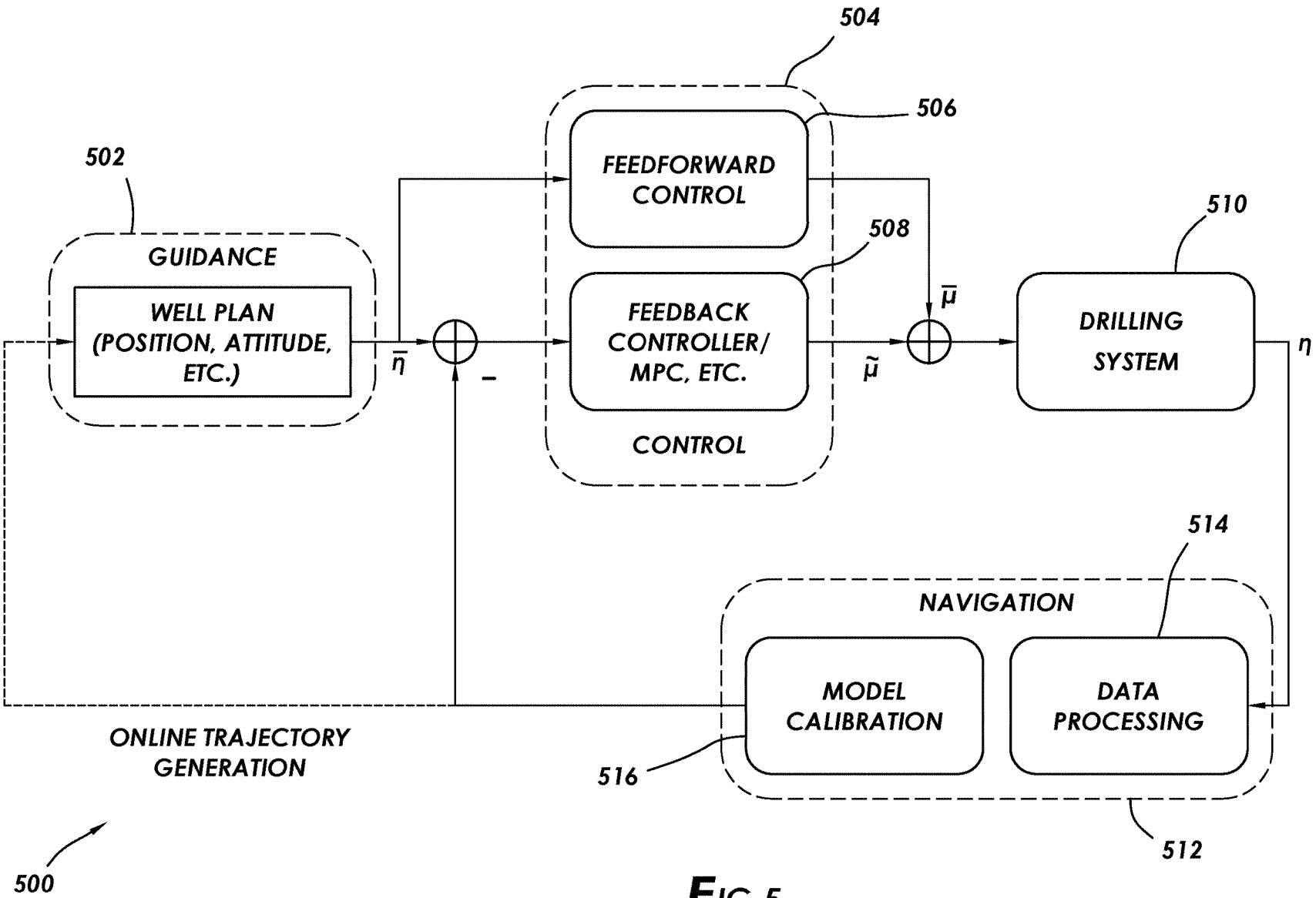
FIG. 5 illustrates an example control system for generation of drilling parameters.

FIG. 5 illustrates an example of a control system 500 for steering a drill bit (e.g., drill bit 122. The control system 500 includes guidance system 502, a motion control system 504, a drilling system 510, and a navigation system 512. The motion control system 504 includes a feedforward controller 506 and the feedback controller 508. In operation, the control system 500 may operate to provide control commands from the motion control system block 504 to the drilling system 510. In some embodiments, the control commands may urge drilling along (or toward) the planned wellbore trajectory (e.g., planned wellbore trajectory 404), for example, where the actual trajectory has deviated from the plan.

The guidance system 502 may provide high-level instruction to the control system 500. Such instructions may relate, for example, to environmental information, geological information, and operational requirements to achieve a desired well plan. For example, inputs to the guidance system 502 may include Logging While Drilling ("LWD") measurements, which may provide geological and stratigraphic information. The guidance system may also receive information from the Measurement While Drilling ("MWD") sensors which may provide information regarding tool capability measurements. The outputs from the guidance system 502 may include nominal control objectives, such as measured depth, true vertical depth, inclination, azimuth, build rate, and walk rate. The well plan associated with guidance system 502 may be designed prior to initiation of drilling operations or may be modified contemporaneously with the drilling operations. The well plan indicates the desired well path (or trajectory) to form the well bore (e.g., well bore 102 on FIG. 1). The well plan includes, for example, the desired attitude and position of the drill bit as it traverses the well path.

The motion control system 504 may provide the algorithm to direct the bit according to a well plan and may further monitor and account for system stability and drill efficiency. Motion control system 504 may include the feedforward controller 506 and the feedback controller 508. The inputs to motion control system 504 may include the well plan provided by guidance system 502 along with filtered sensor data and model parameters provided by navigation system 512. The output of motion control system 504 may be a summation of the outputs from feedforward controller 506 and feedback controller 508. The feedforward controller 506 may function within the motion control system 504 to identify control commands with a similar accuracy to that of a stand-alone feedback model at a reduced computational cost. Feedforward controllers are generally open-loop controllers. In the illustrated embodiment, the feedforward controller 506 may receive information regarding the states (nominal control objectives) from the well plan which may be provided by guidance system 502. The feedforward controller 506 may include a feedforward model, which may further include a model-based inversion of the physical model, wherein the physical model may be a mathematical mode of the drilling system 510. The physical model can be a linear or non-linear model. In some embodiments, the physical model includes a linear, first order model. The feedforward controller 506 may generate one or more nominal control commands from application of the physical model, which may include a nominal tool face and a nominal duty cycle. In some embodiments, the feedforward controller 506 may be designed to generate one or more nominal control commands by applying a dynamic inversion technique to the physical model.

The motion control system 504 includes the feedback controller 508. Feedback controllers are generally closed-loop controllers. In the illustrated embodiment, the feedback controller 508 receives sensor data from data processing 514 and the model calibration parameters from model calibration 516. The feedback controller 508 may function within the controller 508 to output a control command error value. In conventional feedback controllers, the feedback controller 508 operates in the full search space between the initial condition and the control objective. However, example embodiments implement an error-based feedback controller 508 that utilizes a smaller search space. By operating in the error space, the feedback controller 508 may implement more complex control techniques (e.g., model predictive controller) without undesirably increasing computing resources.

Furthermore, the feedback controller may include a feedback model. The feedback model may iteratively determine, calculate, or solve for a cost function to identify control commands for the drilling system 510 according to a planned depth-based well trajectory. The cost functions may be generated in the error space based on different control objective, like position control or attitude control. To achieve the control objective, the target is to minimize the cost function under some constraints. These constraints could be tool capability, control constraints, or other constraints. The feedback controller can use a linear or non-linear model. In some embodiments, the feedback controller applies the physical model of the drilling system described above. In non-limiting examples, feedback controller 508 may include proportional controllers, integral controllers, derivative controllers, proportional derivative controllers ("PD"), proportional integral controllers ("PI"), proportional-integral-derivative controllers ("PID"), model predictive controllers ("MPC"), linear quadratic regulators ("LQR"), and fuzzy logic controllers ("FLC").

The nominal control command from the feedforward controller 506 and the control command error value from the feedback controller 508 may be combined to provide a control command to the drilling system 510. As illustrated, the control command from the motion control system 504 may be output to the drilling system 510. By updating the control command based on the output from the motion control system 504, the drilling system 504 may be urged along (or toward) the original well plan as deviations may occur during drilling.

The navigation system 512 includes data processing 514 and model calibration 516. The navigation system 512 may provide real-time measurements indicative of the control objectives (or drilling state), including, the inclination, azimuth, rate of penetration, and weight on bit. Inputs to the navigation system 512 may include raw data from one or more sensors which may be disposed at any point within the wellbore. In a non-limiting example, the sensors may include At Bit Inclination ("ABI") and Direct Inclination ("D&I") sensors. In order to provide the other systems with smooth and reliable data, the raw data may be filtered by a variety of filtering algorithms including but not limited to lowpass filters, particle filters, and Kalman filters. Furthermore, the filtered sensors data may be used to calibrate the physical model parameters of the physical model in model calibration 516.

A linearized description of the tracking error dynamics may be developed as follows. A nonlinear dynamic system may generally be described by the following equations:

$$\dot{\xi}=f(\xi(t),\mu(t)) \quad \text{Equation 1}$$

$$\eta(t)=h(\xi(t),\mu(t)) \quad \text{Equation 2}$$

where $\xi(t)\in \mathbb{R}^n$,, $\mu(t)\in \mathbb{R}^l$,, $\eta(t)\in \mathbb{R}^m$ represent the system state, control input, and control output, respectively. The control inputs represented by $\mu(t)$ may also be referred to as the "control commands," where non-limiting examples include TF, duty cycle, and steering ratio. The outputs represented by $\eta(t)$ may also be referred to as the "control objective", where non-limiting examples include attitude tracking and position control.

Equation (1) and (2) may be further developed by incorporating the nominal state ($\bar{\xi}(t)$), nominal output ($\bar{\eta}(t)$), and nominal control commands ($\bar{\mu}(t)$) resulting as follows:

$$\dot{\bar{\xi}}=f(\bar{\xi}(t),\bar{\mu}(t)) \quad \text{Equation 3}$$

$$\bar{\eta}=h(\bar{\xi}(t),\bar{\mu}(t)) \quad \text{Equation 4}$$

A tracking error may be formulated as:

$$\tilde{\xi}=\xi(t)-\bar{\xi}(t) \quad \text{Equation 5}$$

$$\tilde{\eta}(t)=\eta(t)-\bar{\eta}(t) \quad \text{Equation 6}$$

$$\tilde{\mu}(t)=\mu(t)-\bar{\mu}(t) \quad \text{Equation 7}$$

where $\tilde{\xi}(t)$ may be the error variable of the system state, $\tilde{\mu}(t)$ may be the error variable of the control input, and $\tilde{\eta}(t)$ may be the error variable of the control output. Incorporating equations (5), (6), and (7) into the error-based dynamic system of equations (3) and (4) may result in the following:

$$\dot{\tilde{\xi}}(t)=f(\bar{\xi}(t)+\tilde{\xi}(t),\bar{\mu}(t)+\tilde{\mu}(t))-f(\bar{\xi}(t),\bar{\mu}(t)) \quad \text{Equation 8}$$

$$\dot{\tilde{\eta}}(t)=h(\bar{\xi}(t)+\tilde{\xi}(t),\bar{\mu}(t)+\tilde{\mu}(t))-h(\bar{\xi}(t),\bar{\mu}(t)) \quad \text{Equation 9}$$

A dynamic inversion technique may be applied to equations (8) and (9) to create an open-loop controller as depicted by feedforward controller 506 which is a component of workflow 500. The feedforward controller may determine the nominal control command. Incorporating the nominal control commands with the feedback controller 508 may reduce the computational requirement. It should be understood that present embodiments are not limited to the implementation of Equations 8 and 9 but rather Equations 8 and 9 are provided to illustrate an example technique for the feedforward controller.

Feedback controller 508 may be a closed-loop control and may account for nuanced components of the system such as model calibration error, external disturbance, and/or internal perturbations. The computational cost may be further decreased by using the linearized model of physical model 510 at the nominal control point. The tracking error dynamics may be linearized along the reference trajectory as follows:

$$\dot{x}=A_C x+B_C u \quad \text{Equation 10}$$

$$y=C_C x+D_C u \quad \text{Equation 11}$$

where $$A_C=\frac{\partial}{\partial \xi} f(\xi,\mu)\big|_{\bar{\xi},\bar{\mu}} \quad \text{Equation 12}$$

$$B_C=\frac{\partial}{\partial \mu} f(\xi,\mu)\big|_{\bar{\xi},\bar{\mu}} \quad \text{Equation 13}$$

$$C_C=\frac{\partial}{\partial \xi} h(\xi,\mu)\big|_{\bar{\xi},\bar{\mu}} \quad \text{Equation 14}$$

-continued $$D_C = \frac{\partial}{\partial \mu} h(\xi, \mu)|_{\bar{\xi}, \bar{\mu}} \quad \text{Equation 15}$$

and where x, y and u are the linear approximation of the nonlinear state tracking error, output tracking error and tracking error control input, respectively.

Figure 6A:
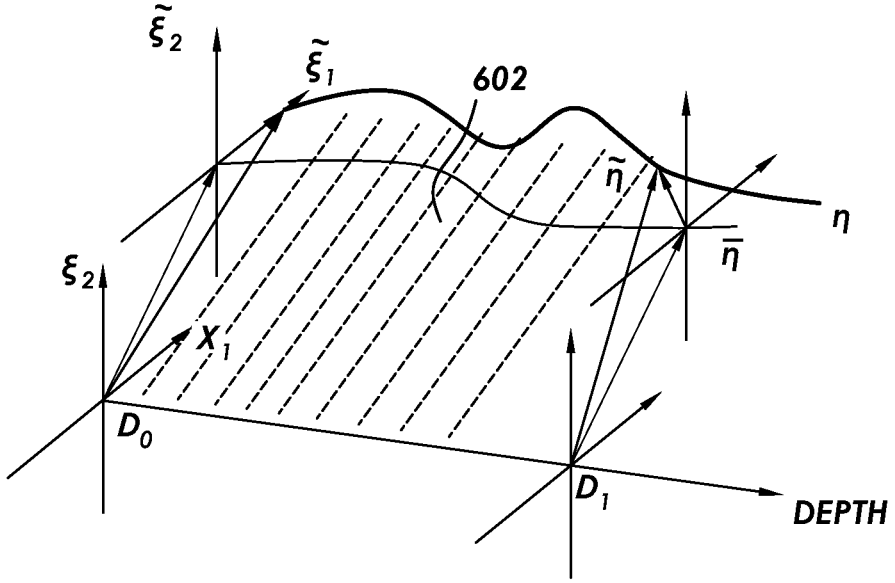
FIGS. 6A and 6B illustrate an error space before and after nominal control commands are determined.
Figure 6B:
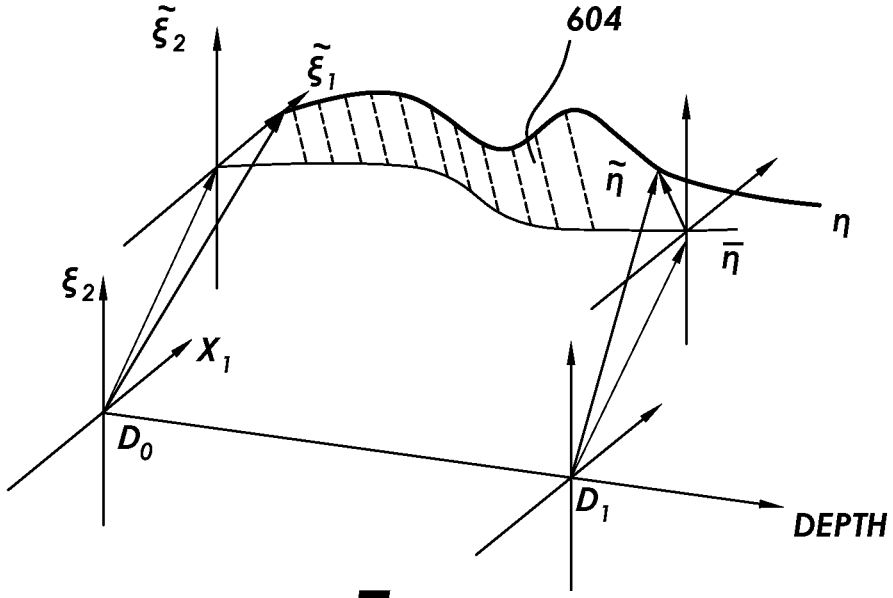

An example of the reduction in search space for solution convergence may be illustrated in FIGS. 6A and 6B. The initial search space prior to implementation of the feedforward controller may be depicted as the hatch-marked area 602. Here, the initial search space of area 602 may also be referred to as the "full search space." The reduced searching space in which the feedback controller 508 may seek a solution may be depicted as the hatch-marked area 604. The reduced search space depicted in area 604 may also be referred to as the "error space." The aforementioned cost functions will be generated on the error space instead of the full search space. With the updated error space, the optimization solution could be found with more efficiency. Within the reduced search space, the feedback controller may converge to the target on one or more control commands based on the control objective. Non-limiting examples of control commands may include TF and duty cycle. The control commands of feedback controller may be the resultant control commands of motion control system 504. As previously mentioned, directional drilling systems may operate completely autonomously or may involve human intervention. As such, the control commands determined from the controller may be relayed to technical staff for review prior to proceeding with the drilling operation, or the control commands may be relayed directly to the downhole tools for continued autonomous operations. Furthermore, with additional reference to FIG. 1, the calculations to determine nominal control commands and control commands may take place within BHA 130, measurement assembly 134, sensor 136, in the general area of drilling system 100 ("on location"), or at an offsite location. As the drilling operation proceeds forward, sensors 136 near the drill bit 122 may gather directional data which may allow for real-time model calibration and data processing as depicted in blocks 516 and 514, respectively. These sensors 136 may help keep the directional drilling system on track with the target planned depth-based well trajectory until the next survey point is reached. As previously mentioned, the drilling model may be formulated as three different subsystems including the bit/rock interface law, kinematic relationships between bit penetration and the geometry of the wellbore, and a Bottom Hole Assembly ("BHA") model which may relate wellbore geometry with the force acting on the BHA. In some examples, these models may be calibrated by incorporating data from previously drilled sections of the wellbore. Furthermore, these models may be utilized as inputs which fine-tune or calibrate a depth-based motion control system 504 used to identify control commands.

It should be noted that the processes and components of control system 500 are displayed in a certain sequence, but it is not necessary to adhere to this specific sequence in all examples to achieve the objectives of control system 500. For example, some process and components may be performed out of order or simultaneously. In some examples a technical professional may determine when surveys are acquired to assess the location of the well relative to the planned depth-based well trajectory. In other embodiments the survey points are pre-planned based on thresholds such as depth, duration, or number of steering actions taken. In further embodiments, the aforementioned sensors 136 located near drill bit 122 may acquire and assess real-time trajectory data and autonomously determine to acquire a new survey. Alternatively, the foregoing sensors 136 located near drill bit 122 may acquire real-time trajectory data, determine if the data meets a specific tolerance, and alert technical professionals if the tolerance isn't met to allow technical professionals to determine whether to take a survey.

Figure 7:
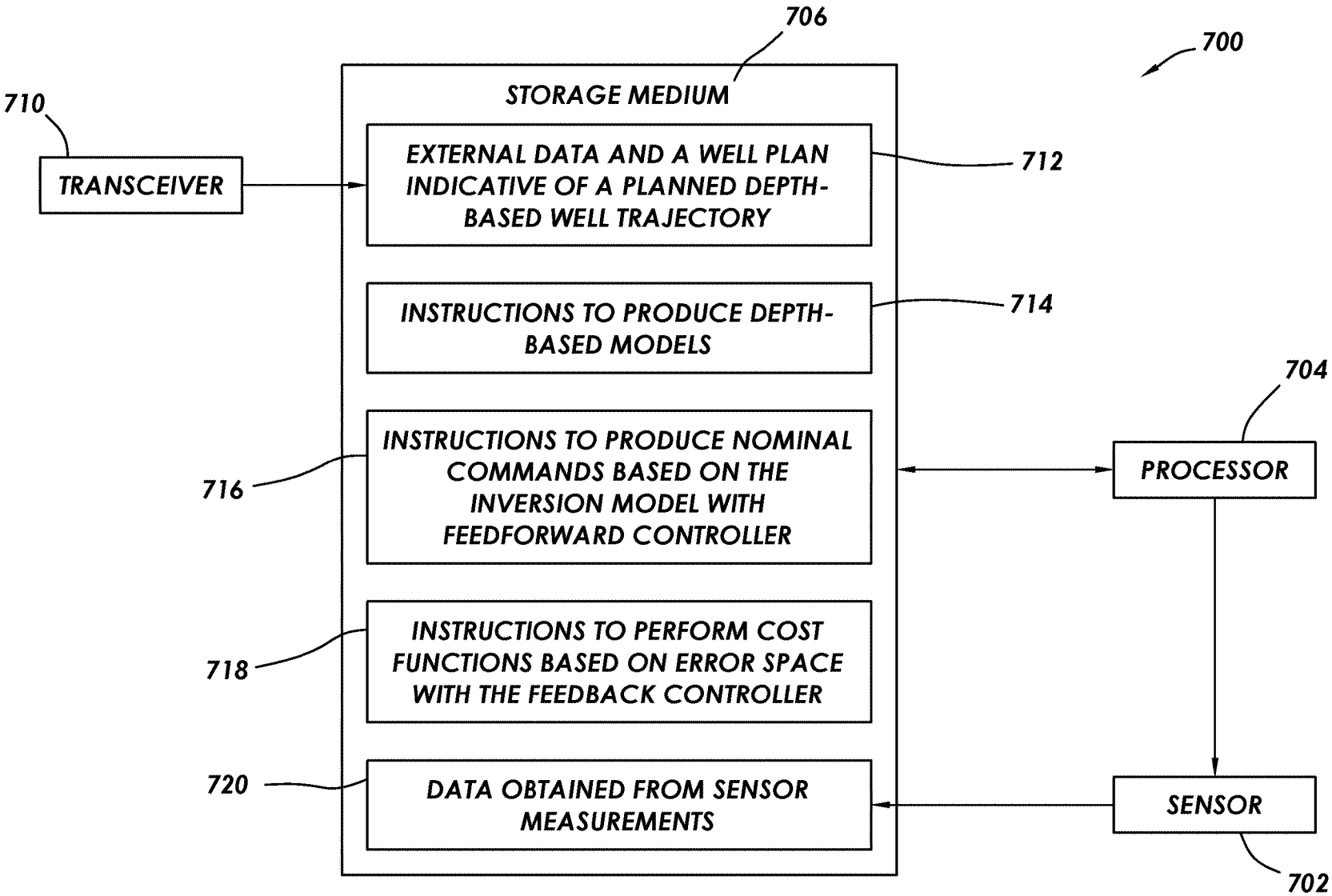
FIG. 7 illustrates a block diagram of an example of the steering portion of the drilling system

FIG. 7 provides a block diagram to illustrate an example of the steering portion of the drilling system. The steering portion of the drilling system may include sensors 702 (e.g., sensors 136 on FIG. 1), processors 704, and storage media 706. The storage media 706 may also be referred to as "non-transitory computer-readable media," and may include any instrumentality or aggregation of instrumentalities that may retain data and/or instructions for a period of time. Non-limiting examples of these storage media may include a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, microwaves, radio waves, and other electromagnetic and/or optical carriers; and/or any combination of the foregoing. In some examples, storage media 706 includes multiple data storage devices, and in further examples storage media 706 may be physically located at different locations. In some examples, the processors 704 and/or storage media 706 may be a component of the information handling system 131 at the surface 108.

External data 712 such as a planned depth-based well trajectory, offset well information, information regarding geological models, and any data collected or measured as part of the drilling process along with calculations and solutions related to cost functions and physical models may be transmitted to the steering portion of the drilling system (e.g., drilling system 100 on FIG. 1) by way of a transceiver 708. Additionally, data, calculations, and instructions from any of the aforementioned sources may be transmitted to one or more storage media 706 which may be integral to the BHA (e.g., BHA 130 on FIG. 1) or stored at a different location. External data 712 relayed by the transceiver 708 may be used in combination with instructions stored on storage media 706 to produce depth-based models 714.

Processor 704 may execute the instructions to produce nominal control commands based on the inversion model of the feedforward controller 716. Processor 704 may execute these instructions regularly, intermittently, periodically, or on an ad hoc basis as determined by a technical professional. The nominal control commands determined from feedforward controller 716 may be relayed as the starting point to perform cost functions based on an error space using the feedback controller 718 to determine control command error values. The control command error values may be combined with the nominal control commands to provide a control command used to direct the steering assembly towards the planned depth-based well trajectory (e.g., planned depth-based well trajectory 402 on FIG. 4). As the steering system progresses the wellbore towards the planned depth-based well trajectory, data obtained from sensor measurements 720 monitor the wellbore progress to determine or suggest if processor 704 needs to execute additional calculations or commands.

Accordingly, the present disclosure may provide methods, systems, and apparatus for directing a bottomhole assembly of a drilling system. The methods, systems, and apparatus may include any of the various features disclosed herein, including one or more of the following statements.

Statement 1. A method of steering a drilling bit comprising: determining at least one control command to a drilling system, wherein the control command comprises a combination of one or more nominal control commands output from a feedforward controller and one or more control command error values output from a feedback controller operating in an error space; and directing the drill bit of the drilling system in the wellbore based on at least the control command to extend the wellbore towards a planned depth-based wellbore trajectory.

Statement 2. The method of statement 1, wherein the at least one control command comprises tool face, steering ratio, or a combination thereof.

Statement 3. The method of statement 1 or statement 2, further comprising applying an inverted model in the feedforward controller to output the nominal control command.

Statement 4. The method of statement 3, wherein the inverted model comprises an inverted linear first order model.

Statement 5. The method of any preceding statement, further comprising applying a feedback model in the feedback controller to output the control command error value.

Statement 6. The method of statement 5, wherein the feedback model comprises a linear, first order model.

Statement 7. The method of statement 5, wherein the feedback model comprises a non-linear model.

Statement 8. The method of any preceding statement, wherein the feedback controller comprises at least one controller selected from the group consisting of a proportional controller, integral controller, derivative controller, proportional derivative controller, proportional integral controller, proportional-integral-derivative controller, linear quadratic regulator, fuzzy logic controller, and a model predictive controller.

Statement 9. The method of any preceding statement, wherein the feedback controller solves a cost function to determine the one or more control command error values.

Statement 10. A method of steering a drilling bit comprising: receiving a well plan indicative of a planned well trajectory; applying a feedforward model to generate nominal control commands, wherein input to the feedforward model comprise nominal control objectives from the well plan; determining control command error values from a model predictive controller of a feedback controller operating in an error space; combining the nominal control commands and the control command error values to obtain control commands; and directing a drill bit in the wellbore based on at least the control command.

Statement 11. The method of statement 10, wherein the control commands comprise tool face and steering ratio.

Statement 12. The method of statement 10 or statement 11, wherein the feedforward model comprises an inverted model of a drilling system.

Statement 13. The method of any one of statements 10-12, wherein the feedforward model comprises an inverted linear first order model.

Statement 14. The method of any one of statements 10-13, wherein the control objectives comprise at least one measurement selected from the group consisting of inclination, azimuth, rate of penetration, weight on bit, and combinations thereof.

Statement 15. The method of any one of statements 10-14, wherein feedback control receives inputs comprising model calibration parameters and measured control objectives from a previously drilled section of the wellbore.

Statement 16. A control system for steering a drill bit, comprising: a guidance system comprising a well plan; a motion control system comprising a feedforward control and a feedback control, wherein the feedforward control is configured to receive nominal control objectives of the well plan and output one or more nominal control commands; wherein the feedback control is configured to receive input of measured control objectives from a previously drilled wellbore section and output one or more control command error values; wherein the motion control system is configured to output at least one control command to a drilling system, wherein the at least one control command comprises a summation of the one or more nominal control commands and the one or more control command error values; and a navigation system configured to measure control objectives of the drilling system.

Statement 17. The control system of statement 16, wherein the at least one control command comprises tool face, steering ratio, or a combination thereof.

Statement 18. The control system of statement 16 or statement 17, wherein the feedforward control comprises instructions to determine the one or more nominal control commands based on an inverted model.

Statement 19. The control system of statement 18, wherein the feedback control comprises instructions to perform cost functions in the error space to determine the one or more control command error values.

Statement 20. The control system of statement 19, wherein the instructions of the feedforward control and the instructions of the feedback control are on one or more storage media.

The systems and methods may include any of the various features disclosed herein, including one or more of the following statements. The systems and methods may include any of the various features disclosed herein, including one or more of the following statements.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A control system for steering a drill bit, comprising:
a guidance system comprising a well plan;
a motion control system comprising:
a feedforward control, wherein the feedforward control is configured to receive nominal control objectives of the well plan and output one or more nominal control commands; and
a feedback control, wherein the feedback control is configured to receive input of measured control objectives from a previously drilled wellbore section and output one or more control command error values, wherein the motion control system is configured to output at least one control command to a drilling system, and wherein the at least one control command comprises a summation of the one or more nominal control commands and the one or more control command error values; and
a navigation system configured to measure control objectives of the drilling system.

2. The control system of claim 1, wherein the at least one control command comprises tool face, steering ratio, or a combination thereof.

3. The control system of claim 1, wherein the feedforward control comprises instructions to determine the one or more nominal control commands based on an inverted model.

4. The control system of claim 3, wherein the feedback control comprises instructions to perform cost functions in the error space to determine the one or more control command error values.

5. The control system of claim 4, wherein the instructions of the feedforward control and the instructions of the feedback control are on one or more storage media.

6. The control system of claim 3, wherein the inverted model comprises an inverted linear first order model.

7. The control system of claim 1, wherein the feedback control comprises a linear, first order model.

8. The control system of claim 1, wherein the feedback control comprises a non-linear model.

9. The control system of claim 1, wherein the guidance system further comprises Logging While Drilling ("LWD") measurements or Measurement While Drilling ("MWD") measurements.

10. The control system of claim 1, wherein the feedback controller comprises at least one controller selected from the group consisting of a proportional controller, integral controller, derivative controller, proportional derivative controller, proportional integral controllers, proportional-integral-derivative controllers, model predictive controllers, linear quadratic regulators, and fuzzy logic controllers.

11. The control system of claim 1, wherein the control objectives of the drilling system comprise at least one control objective selected from the group consisting of inclination, azimuth, rate of penetration, weight on bit, and combinations thereof.

12. The control system of claim 1, wherein one or more inputs to the navigation system comprise raw data from one or more sensors disposed at any location within a wellbore.

13. A control system for steering a drill bit, comprising:
a guidance system comprising a well plan;
a motion control system comprising:
a feedforward control, wherein the feedforward control is configured to receive nominal control objectives of the well plan and output one or more nominal control commands; and
a feedback control, wherein the feedback control is configured to receive input of measured control objectives from a previously drilled wellbore section and output one or more control command error values, wherein the motion control system is configured to output at least one control command to a drilling system, wherein the at least one control command comprises a summation of the one or more nominal control commands and the one or more control command error values, and wherein the at least one control command comprises tool face, steering ratio, or a combination thereof; and
a navigation system configured to measure control objectives of the drilling system, wherein one or more inputs to the navigation system comprise raw data from one or more sensors disposed at any location within a wellbore.

14. The control system of claim 13, wherein the feedforward control comprises instructions to determine the one or more nominal control commands based on a dynamic inversion of a physical model.

15. The control system of claim 14, wherein the feedback control comprises instructions to perform cost functions in the error space to determine the one or more control command error values.

16. The control system of claim 14, wherein the inverted model comprises an inverted linear first order model.

17. The control system of claim 13, wherein the feedback controller comprises at least one controller selected from the group consisting of a proportional controller, integral controller, derivative controller, proportional derivative controller, proportional integral controllers, proportional-integral-derivative controllers, model predictive controllers, linear quadratic regulators, and fuzzy logic controllers.

18. The control system of claim 13, wherein the feedback control comprises instructions to perform cost functions in the error space to determine the one or more control command error values.

19. The control system of claim 13, wherein the guidance system further comprises Logging While Drilling ("LWD") measurements or Measurement While Drilling ("MWD") measurements.

20. The control system of claim 13, wherein the control objectives of the drilling system comprise at least one control objective selected from the group consisting of inclination, azimuth, rate of penetration, weight on bit, and combinations thereof.

* * * * *